US006243900B1

(12) United States Patent
Gladney et al.

(10) Patent No.: US 6,243,900 B1
(45) Date of Patent: Jun. 12, 2001

(54) ONE-SIDED MATTRESS CONSTRUCTION

(75) Inventors: Rick F. Gladney, Fairburn; Kurtis Ling; Douglass D. Kinde, both of Alpharetta, all of GA (US)

(73) Assignee: Simmons Company, Atlanta, GA (US)

( * ) Notice: Subject to any disclaimer, the term of this patent is extended or adjusted under 35 U.S.C. 154(b) by 0 days.

(21) Appl. No.: 09/482,591

(22) Filed: Jan. 13, 2000

(51) Int. Cl.[7] ..... A47C 27/05
(52) U.S. Cl. ..... 5/720; 5/727
(58) Field of Search ..... 5/720, 716, 727, 5/721, 655.8

(56) References Cited

U.S. PATENT DOCUMENTS

| | | | | |
|---|---|---|---|---|
| 685,160 | | 10/1901 | Marshall . | |
| 1,321,095 | * | 11/1919 | Genge | 5/720 |
| 1,459,540 | * | 6/1923 | Labenz | 5/720 |
| 3,031,690 | * | 5/1962 | Ramsay | 5/720 |
| 4,234,983 | | 11/1980 | Stumpf | 5/246 |
| 4,234,984 | | 11/1980 | Stumpf . | |
| 4,439,977 | | 4/1984 | Stumpf | 53/428 |
| 4,451,946 | | 6/1984 | Stumpf . | |
| 4,523,344 | | 6/1985 | Stumpf . | |
| 4,578,834 | | 4/1986 | Stumpf . | |
| 5,016,305 | | 5/1991 | Suenens et al. . | |
| 5,621,935 | | 4/1997 | St. Clair . | |
| 5,787,532 | | 8/1998 | Langer et al. | 5/717 |

* cited by examiner

*Primary Examiner*—Alexander Grosz
(74) *Attorney, Agent, or Firm*—Smith, Gambrell & Russell, LLP

(57) ABSTRACT

A one-sided mattress assembly includes a core of pocketed coil springs having a layer of resiliently compressible material covering the upper surface thereof and having a bottom surface constructed of a substantially rigid material without a compressible layer. The core of coil springs is preferably attached to the bottom surface only around its periphery. By such a construction the amount of compressible padding is reduced by one-half and consequently the mattress is capable of exhibiting a substantial reduction in the amount of permanent deflection in use. Maintenance of the mattress such as by rotating or turning the mattress over is also avoided.

23 Claims, 2 Drawing Sheets

ONE-SIDED MATTRESS CONSTRUCTION

BACKGROUND OF THE INVENTION

1. Field of the Invention

The present invention relates generally to mattress assemblies and, more particularly, to one-sided mattress assemblies that offer significant reduction in the amount of permanent deflection resulting from the compaction of padding materials under normally encountered loads.

2. Description of the Related Art

A conventional inner spring mattress as known in the bedding industry generally comprises a resilient construction consisting of two sleep surfaces (top and bottom) enclosing an assembly of wire springs. The springs are typically covered over with padding on the top and bottom surfaces and the whole assembly is encased within a ticking, often quilted, that is sewn closed around its periphery to a border or boxing. For many years one preferred form of spring assembly construction has been known as Marshall construction. In Marshall construction individual wire coils are each encapsulated in fabric pockets and attached together in strings which are arranged to form a closely packed array of coils in the general size of the mattress. Examples of such construction are disclosed in U.S. Pat. No. 685,160, U.S. Pat. No. 4,234,983, U.S. Pat. No. 4,234,984, U.S. Pat. No. 4,439,977, U.S. Pat. No. 4,451,946, U.S. Pat. No. 4,523,344, U.S. Pat. No. 4,578,834, U.S. Pat. No. 5,016,305 and U.S. Pat. No. 5,621,935, the disclosures of which are incorporated herein by reference in their entireties.

Conventionally, inner spring mattresses have identical top and bottom surfaces. During normal life of such conventional mattresses some degree of permanent deflection, or sag, can develop in the mattress surfaces due to compaction of the component padding materials. This permanent deflection can interfere with the mattresses' intended function of providing a supportive and resilient sleep surface. Inner spring mattress manufacturers recommend periodically rotating and turning over the mattress utilizing the top and bottom sleep surfaces in order to counteract, minimize and/or delay the aforementioned permanent deflection. Under continued use, this compaction becomes more permanent. The degree of permanent deflection is directly related to the type and amount of padding installed both over and under the wire spring assembly. To remedy this shortcoming, manufacturers utilize materials that produce less permanent compaction. These materials are generally more dense, but can be less comfortable and more expensive.

Accordingly, it is desirable to provide an inner spring mattress assembly which exhibits a reduced amount of permanent deflection due to compaction of padding materials while at the same time exhibiting substantial comfort in use. It is further desirable to provide such a mattress assembly that can be constructed by conventional known manufacturing techniques. Still further, it is desirable to provide such a mattress assembly that is cost-effective to produce.

SUMMARY OF THE INVENTION

The present invention improves over the prior art by providing a one-sided mattress assembly including a core of pocketed coil springs having a layer of resiliently compressible material covering the upper surface thereof and having a bottom surface constructed of a substantially rigid material without a compressible layer. The core of coil springs is preferably attached to the bottom surface only around its periphery. By such a construction the amount of compressible padding is reduced by one-half and consequently the mattress is capable of exhibiting a substantial reduction in the amount of permanent deflection in use. Maintenance of the mattress such as by rotating or turning the mattress over is also avoided.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
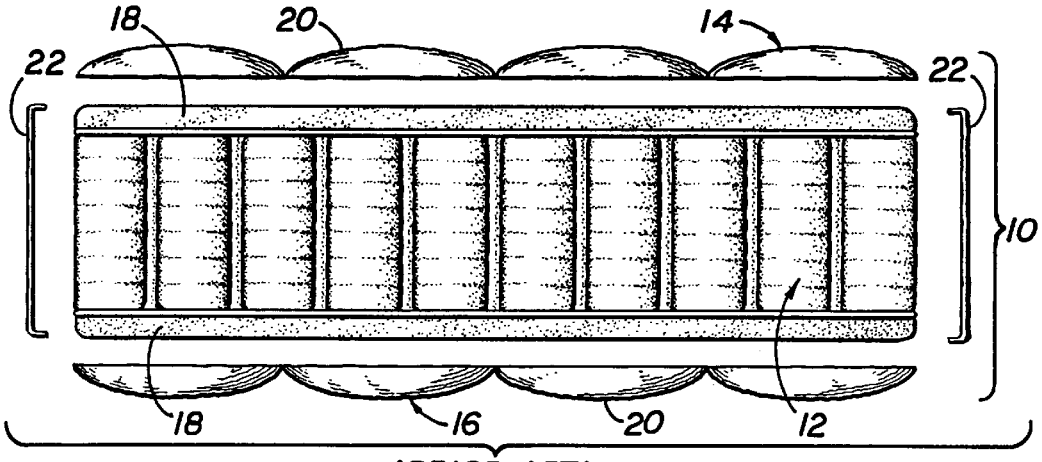
(PRIOR ART) FIG 1
FIG. 1 is an exploded cross-sectional view of a conventional two-sided inner spring mattress construction.

Referring now to the drawings, and initially to FIG. 1, a conventional two-sided mattress is illustrated in exploded cross-section and designated generally by the reference numeral 10. The mattress includes as a principal component an assembly of Marshall spring coils 12, as will be described in detail hereinafter and which comprises the central core of the mattress 10. The mattress has an upper sleep surface 14 and a lower sleep surface 16 and, therefore, is of a conventional type intended to be turned over periodically to help minimize compression of its padding material. The padding material, which is preferably identical on both sides 14 and 16 includes a layer of closed-cell foam 18 such as made of polyurethane. Covering the foam layer is a ticking layer 20 which may be quilted with additional foam in a manner well-known in the art. The ticking layers 20 are fastened such as by sewing to a border 22 which extends around the entire periphery of the core of coil springs 12.

Figure 2:
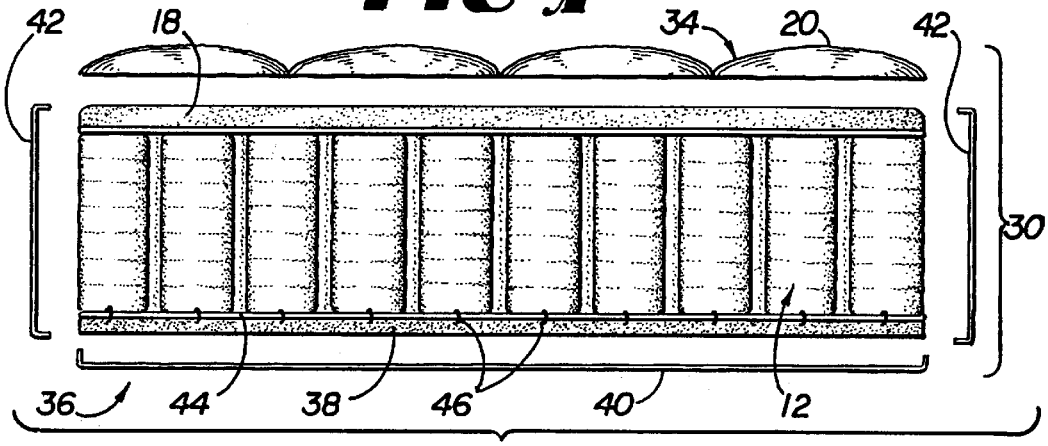
FIG. 2 is an exploded cross-sectional view of a one-sided inner spring mattress constructed according to the principles of the invention.

Turning now to FIG. 2, a mattress constructed according to the invention is shown in exploded cross-section and designated by the reference numeral 30. This mattress, like the conventional mattress 10 illustrated in FIG. 1 preferably has a central core 12 of Marshall coils on which an upper sleep surface 34 is formed with a layer of foam padding 18 and a cover layer of ticking 20. However, in accordance with the invention, the mattress 30 has an underside 36 which comprises a substantially rigid layer of material 38 covered by a thin layer 40 preferably of a non-woven sheeting. A border 42 connects the ticking 20 and sheeting layer 40 and extends around the periphery of the coil assembly 12. A lower border wire 44 is secured to the coil assembly 12 around its periphery as well as to the layer 38 such as by hog rings 46.

Figure 3:
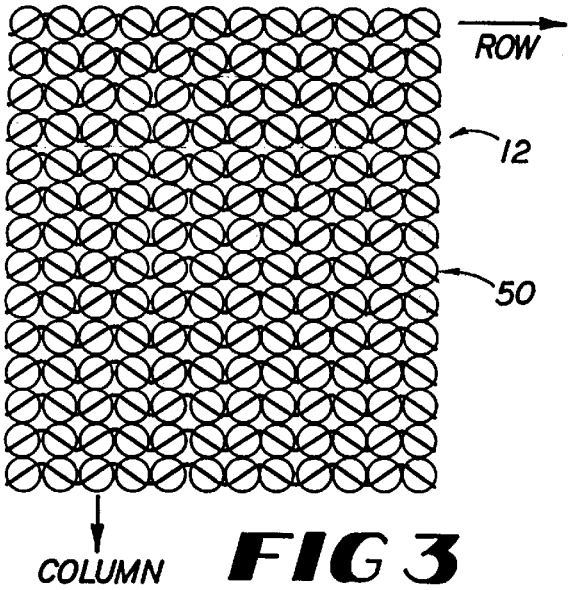
FIG. 3 is a schematic plan view of a complete assembly of Marshall coils for use in the mattress construction according to the present invention as illustrated in FIG. 2.
Figure 4:
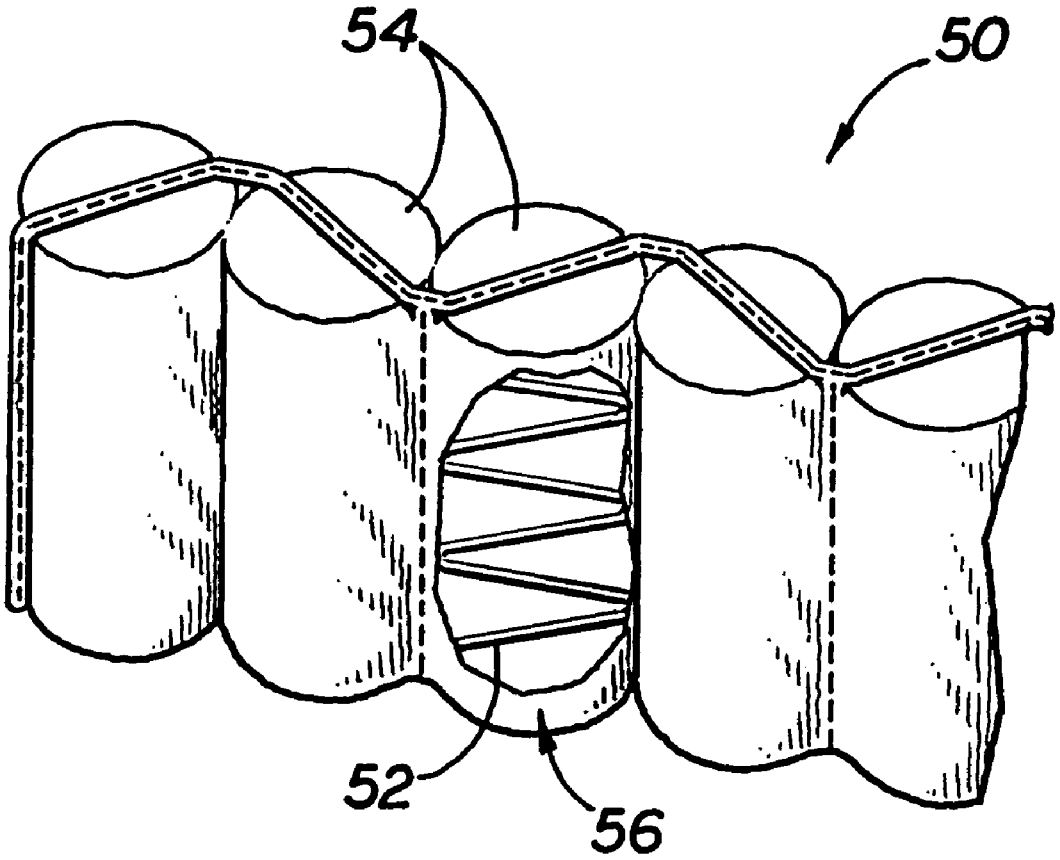
FIG. 4 is a partial perspective view, partly broken away, of the Marshall coil assembly illustrated in FIG. 3.

FIGS. 3 and 4 illustrate the preferred form of mattress core 12 of the aforementioned Marshall coil construction. In this construction, closely positioned coil springs are aligned in a string assembly 50 (FIG. 4) wherein individual springs 52 are each encapsulated within a pocket 54 of fabric material 56 which may be sewn or ultrasonically welded to create the pockets 54 and to create a unitary Marshall coil type assembly 12. An example of such construction is more fully disclosed in U.S. Pat. No. 5,621,935 which is commonly assigned herewith and the disclosure of which is incorporated herein by reference in its entirety.

It can now be appreciated that a one-sided inner spring mattress 30 constructed according to the invention offers considerable advantages over prior art conventional two-sided mattresses in terms of reducing the amount of permanent deflection of the sleeping surface due to undesirable compaction of padding materials. Because the mattress 30 essentially has a 50 percent reduction in padding due to bottom rigid layer 38, the coil assembly 12 does not settle into and compact a lower padding layer as would happen with a two-sided mattress of conventional construction having identical padding layers on both sides.

In one preferred form the relatively rigid bottom layer 38 is formed of high density polyurethane foam having a weight of approximately 1.85 lbs/cu. ft. The foam layer 38 also preferably has a firmness in a range of between 45 and 60 ILD, where "ILD" stands for Indented Load Deflection. In practice an ILD of 55 has proved to be most effective.

It can also be appreciated that the one-sided mattress 30 of the invention offers the significant advantage of completely eliminating maintenance of the mattress by periodically turning it over as is recommended for conventional two-sided mattresses. Accordingly, it is more convenient for the consumer to use. Further, with the Marshall coil construction and use of conventional materials, the mattress 30 may be readily manufactured by techniques that are well-known in the industry and thus can be produced in a cost-effective manner.

While the present invention has been described in connection with preferred embodiments thereof, it will be apparent to those skilled in the art that many changes and modifications can be made without departing from the true sprit and scope of the present invention. Accordingly, it is intended by the appended claims to cover all such changes and modifications as come within the scope of the invention.

What is claimed is:

1. A one-sided inner spring mattress assembly comprising:

a central core of individual fabric pocketed coil springs arranged in a Marshall coil type assembly;

an upper assembly padding layer extending over a top surface of said core;

a lower relatively rigid layer underlying said core;

wherein said lower layer is resistant to compression by the central core of pocketed springs and comprises a. high density polyurethane foam having a weight of about 1.85 lbs per cubic foot and a firmness in the range of about 45 ILD to about 60 ILD.

2. The mattress assembly of claim 1 wherein the core is surrounded by a lower border wire and is secured to said lower layer only by attaching said border wire to said lower layer.

3. The mattress assembly of claim 1 wherein said lower layer is covered by a thin sheet of non-woven material.

4. The mattress assembly of claim 1 including an upper quilt layer of ticking material.

5. A one-sided inner spring mattress assembly comprising:

a central core of closely positioned individual pocketed coil springs surrounded at a bottom edge by and connected to a border wire;

an upper padding layer overlying the central core; and a bottom relatively rigid layer underlying the core;

wherein said border wire is attached to said bottom layer to hold said bottom layer to said core.

6. The mattress assembly of claim 5 wherein said lower layer comprises high density foam.

7. The mattress assembly of claim 5 wherein said lower layer has a weight of about 1.85 lbs per cubic foot.

8. The mattress assembly of claim 5 wherein said lower layer has a firmness in the range of about 45 ILD to 60 ILD.

9. The mattress assembly of claim 5 wherein said lower layer is constructed of high density polyurethane foam.

10. The mattress assembly of claim 5 wherein said lower layer is covered by a thin sheet of non-woven material.

11. The mattress assembly of claim 5 wherein said upper padding layer is covered by a quilt layer.

12. An innerspring mattress comprising:

a core of individual springs each pocketed in fabric and arranged together to define a unitary spring assembly;

a border wire positioned adjacent a bottom edge of said core and extending around the periphery of said core, said border wire being connected to said spring assembly;

a layer of relatively incompressible material underlying said spring assembly, wherein said layer is connected only to said border wire to attach said layer to said spring assembly.

13. The mattress of claim 12 wherein said layer is formed of high density polyurethane foam.

14. The mattress of claim 12 wherein said layer has a weight of about 1.85 lbs per cubic foot.

15. The mattress of claim 12 wherein said layer has a firmness in the range of about 45 ILD to 60 ILD.

16. The mattress of claim 12 wherein said layer is covered by a thin sheet of non-woven material.

17. A one-sided inner spring mattress assembly comprising;

a central core of closely positioned individual coil springs surrounded at a bottom edge by and connected to a border wire;

an upper padding layer overlying the central core; and a bottom relatively rigid layer underlying the core;

wherein said border wire is attached to said bottom layer to hold said bottom layer to said core.

18. The mattress assembly of claim 17 wherein said lower layer comprises high density foam.

19. The mattress assembly of claim 17 wherein said lower layer has a weight of about 1.85 lbs per cubic foot.

20. The mattress assembly of claim 17 wherein said lower layer has a firmness in the range of about 45 ILD to 60 ILD.

21. The mattress assembly of claim 17 wherein said lower layer is constructed of high density polyurethane foam.

22. The mattress assembly of claim 17 wherein said lower layer is covered by a thin sheet of non-woven material.

23. The mattress assembly of claim 17 wherein said upper padding layer is covered by a quilt layer.

* * * * *